US011519163B2

(12) United States Patent
Braxton

(10) Patent No.: US 11,519,163 B2
(45) Date of Patent: Dec. 6, 2022

(54) SPACE SAVING BATHROOM COMPONENTS

(71) Applicant: Earl Jacob Braxton, Utica, MI (US)

(72) Inventor: Earl Jacob Braxton, Utica, MI (US)

( * ) Notice: Subject to any disclaimer, the term of this patent is extended or adjusted under 35 U.S.C. 154(b) by 129 days.

(21) Appl. No.: 16/254,175

(22) Filed: Jan. 22, 2019

(65) Prior Publication Data

US 2019/0226189 A1 Jul. 25, 2019

Related U.S. Application Data

(60) Provisional application No. 62/620,234, filed on Jan. 22, 2018.

(51) Int. Cl.
*E03D 1/00* (2006.01)
*E03C 1/01* (2006.01)

(52) U.S. Cl.
CPC ..... *E03D 1/003* (2013.01); *E03C 1/01* (2013.01)

(58) Field of Classification Search
CPC ..... A47K 5/12; A47K 5/1202; A47K 5/1204; A47K 5/1208; A47K 5/1211; A47K 5/1214; A61L 2202/16; E03D 1/003; E03C 1/01
See application file for complete search history.

(56) References Cited

U.S. PATENT DOCUMENTS 3,453,665 A 7/1969 Cokic et al.
4,358,864 A 11/1982 Medrano
5,257,423 A * 11/1993 Jacobsen ..... E03B 9/20 312/228
5,522,096 A 6/1996 Brown
5,528,152 A 6/1996 Hinoshita
6,425,148 B1 7/2002 Chen
6,678,902 B1 1/2004 Adriano
9,756,989 B2 * 9/2017 Ophardt ..... H02J 50/30
9,761,079 B1 * 9/2017 Lin ..... G07F 17/18
2007/0199146 A1 * 8/2007 Kostelyk ..... A47K 1/02 4/625
2010/0187251 A1 * 7/2010 Simmons ..... A47K 5/1202 221/96

(Continued)

OTHER PUBLICATIONS plumbingmall.com, Caroma Profile Smart 305 Easy Height Round (White).

(Continued)

*Primary Examiner* — J C Jacyna
(74) *Attorney, Agent, or Firm* — Lynn E. Cargill; Cargill & Associates, PLLC

(57) ABSTRACT

Water and space saving bathroom components especially useful for a comfort station. Included are a novel toilet having a cistern with a sink in combination with the toilet, a novel waterless urinal and a hand sanitizer dispensing station. The sink is an integrally formed sink into the top of the cistern and has a drain formed into the sink for draining effluent from the sink into the toilet cistern. A faucet is installed in the surface of the sink to provide a clean water source for hand washing and the like that generates grey water after washing. The waterless urinal can be plumbed and mounted to a comfort station wall or on a mobile stand, while the hand sanitizer dispensing station may be adapted for multiple dispensers. The dispensers may be mounted at different heights to accommodate adults, children and disabled persons in wheelchairs.

1 Claim, 9 Drawing Sheets

(56) References Cited

U.S. PATENT DOCUMENTS

| | | | | |
|---|---|---|---|---|
| 2011/0303694 | A1* | 12/2011 | Pie | B65D 33/00 222/41 |
| 2012/0187146 | A1* | 7/2012 | Chopra | A61L 2/16 222/52 |
| 2014/0231451 | A1* | 8/2014 | Hammond | A47K 5/12 222/105 |
| 2014/0294670 | A1* | 10/2014 | Wiget | A61L 2/20 422/33 |

OTHER PUBLICATIONS plumbingdeals.com, Caroma Profile Smart Round Front Plus 2 Piece Toilet White.

merlinportabletoilets.com.au—ADU—special needs portable toilets.

* cited by examiner

SPACE SAVING BATHROOM COMPONENTS

CROSS-REFERENCE TO RELATED APPLICATIONS

This application claims the benefit under 35 U.S.C. 119(e) of U.S. Provisional Application No. 62/620,234 filed on Jan. 22, 2018.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS WEB)

Not Applicable

STATEMENT REGARDING PRIOR DISCLOSURES BY THE INVENTOR OR A JOINT INVENTOR

Not Applicable

BACKGROUND OF THE INVENTION

1. Field of the Invention

The present invention relates to space saving bathroom components, including a combination sink and toilet, waterless urinal and hand sanitizer dispenser stand, and particularly relates to these bathroom components adapted for use in a portable comfort station and other related mobile and portable personal relief and sanitizing applications.

2. Description of the Prior Art

Conventional space saving bathroom components have been made in the past to accommodate small indoor bathrooms and outdoor comfort stations. In a quest to provide nice sanitary facilities, such space saving components, including toilet and sink combinations, have been promoted in the past to solve the problem of placing a toilet, a urinal and a sink in limited spaces. Prior attempts have included various aspects of toilet and sink combinations, although none have achieved the purpose of the present invention.

U.S. Pat. No. 6,425,148 issued to Jung-Hua Chen on Jul. 30, 2002 discloses a water-saving device for a toilet comprising a tank, a tank lid mounted on the top of the tank, and a sink formed on the tank that communicates with a chamber in the tank. However, a multitude of plumbing arrangements are needed for the practice of the Chen invention, as well as the implementation of a water saving feature would be desirable to minimize those issues.

Next, we look at U.S. Pat. No. 5,228,152 issued to Florence D. Fraley on Jul. 20, 1993, which discloses a water-saving toilet with a sink mounted to a fixture base above a toilet tank. A drain opening in the bottom of the sink leads directly into the toilet tank, and a domestic water supply shut-off valve in the tank diverts water from the tank and directs it through a water diverting line leading to a spout adjacent the sink. Again, this configuration gives rise to a multitude of problems that the present invention overcomes.

SUMMARY OF THE INVENTION

The present invention provides a complete complement of space saving bathroom components, including, among others, a compact toilet with an incorporated sink in the cistern, thereby eliminating the need for a separate sink within a limited space.

Disclosed is a water and space saving bathroom component especially useful for a comfort station. Included is a novel toilet having a cistern with a sink in combination with the toilet. The sink is an integrally formed sink into the top of the cistern and has a drain formed into the sink for draining effluent from the sink into the toilet cistern. A faucet is installed in the surface of the sink to provide a clean water source for hand washing and the like that generates grey water after washing.

Of special advantage to the construction industry is that there is only at least one water line connected to the faucet from a water source selected from the group consisting of an independent water tank, a garden hose, a main water source, and combinations thereof, thereby alleviating many plumbing connections and making it especially amenable for portability compared to prior art combination toilet/sinks. A potentially portable and removable waste capture and disposal system is in liquid and solid communication with the toilet for easy emptying.

One novel feature is that the grey water is collected from any hand or face washing operations and is re-used to flush the waste from the toilet into the waste capture and disposal system for proper disposal.

The water and space saving toilet may have a dual level flush mechanism for controlling the flushing operation, including both a low flow volume flush level option for liquid waste and a higher volume flush for solid waste disposal. The toilet may be self-contained with a separate waste capture and disposal system selected from the group consisting of a holding tank, a septic system, a sewer system and combinations thereof.

In order to control fluid levels from running the faucet for long periods of time, an optional water level overflow control may be included of a drain mechanism for dispersing overflow water back into the toilet bowl or an automatic shut-off valve may be employed.

Another aspect of the present invention includes a no-flush waterless urinal with a liquid disposal line for draining liquid waste. A liquid disposal line properly stores and/or disposes of collected urine. This novel urinal design can either be a wall mount unit for installation of the no-flush waterless urinal on a wall of a comfort station, and wherein the urine drains into a waste capture and disposal system in communication with a toilet contained in the comfort station. Alternatively, the no-flush waterless urinal can be mounted on a mobile independent standalone unit with a sealable waste holding tank mounted below the no-flush waterless urinal for capturing the urine. Wheels can be mounted on the bottom of the mobile independent standalone unit for portability. Preferably, the no-flush waterless urinal is made of a weatherproof thermoplastic material.

Yet another aspect of the present invention discloses a novel hand sanitizer dispenser of a standalone unit having multiple vertical sides having at least two hand sanitizer dispensers mounted thereon on their face. The bottom of the standalone unit is preferably weighted for stability, and the standalone unit with the hand sanitizer dispensers mounted thereon is convenient for indoor and outdoor applications.

For ease of maintenance by janitorial crew, the waterless hand sanitizer dispenser unit further comprises a front concealment panel to cover and secure similarly sized refill containers of the hand sanitizer material for easy retrieval and maintenance. The present invention may include a four sided vertical standalone unit with hand sanitizer dispensers mounted at least for an adult and for a child or disabled wheelchair bound user, it may include a six or eight sided standalone unit to accommodate a like number of dispensers.

For ease of shipping, the standalone unit can be made of an easy-to-ship flat sheeted material construction with hand sanitizer dispensers that can be mounted on the stand after erection, such that the flat sheeted material can be shipped flat, and the dispensers mounted after assembly. In addition, weights in the bottom of the stand may be used to stabilize the stand in windy conditions or while being used.

BRIEF DESCRIPTION OF THE DRAWINGS

A more complete and full understanding of the aspects and nature of the present invention will become apparent upon considering the following detailed description, when taken in connection with the accompanying drawings, wherein.

Figure 1:
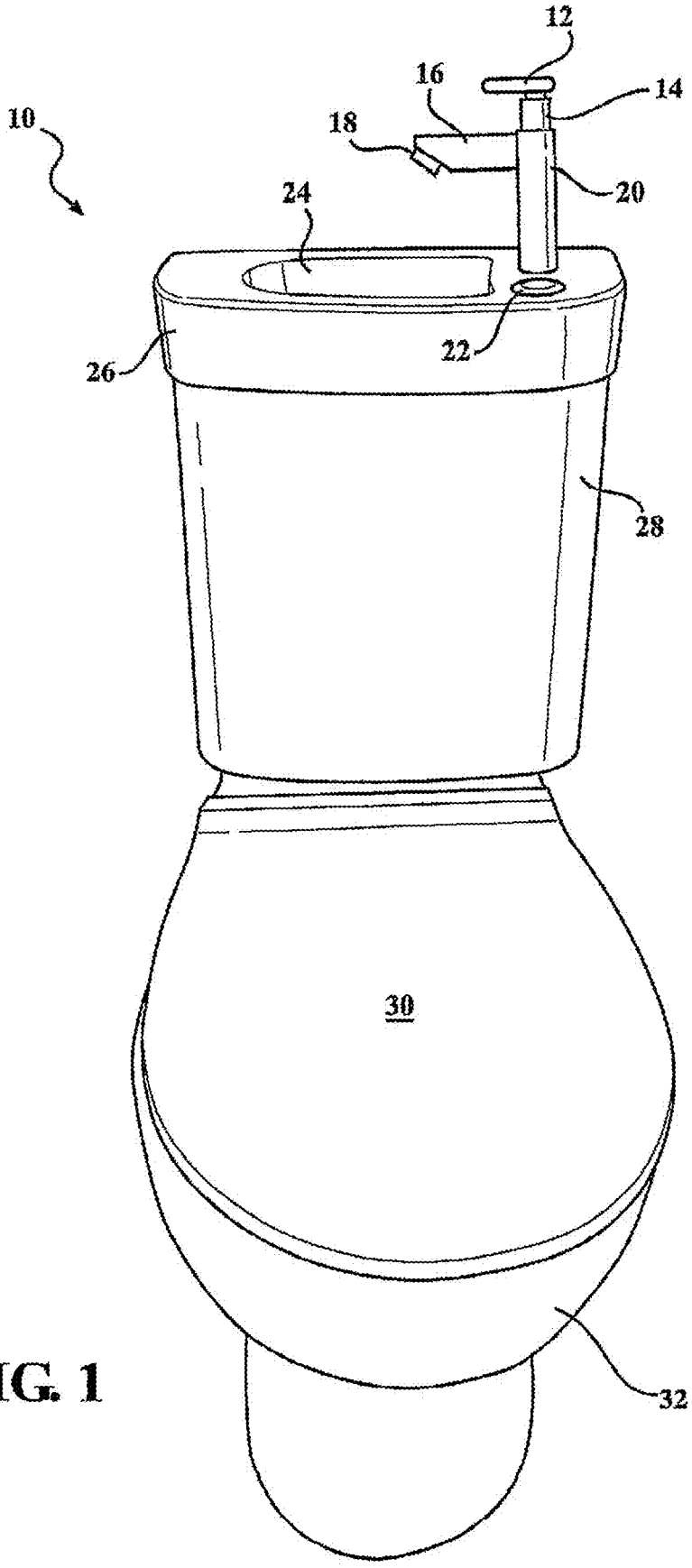
FIG. 1 is a perspective view of a toilet and sink combination made in accordance with the present invention.

| ELEMENT LIST | |
|---|---|
| 10. | Sink/Toilet Combination |
| 12. | Handle |
| 14. | Handle Body |
| 16. | Spout |
| 18. | Aerator |
| 20. | Body |
| 22. | Flush Button |
| 24. | Sink |

-continued

| ELEMENT LIST | |
|---|---|
| 26. | Tank Lid |
| 28. | Tank |
| 30. | Lid |
| 32. | Toilet Bowl |
| 34. | Toilet Base |
| 36. | Model 3448 Operational Model |
| 38. | Foaming Hand Soap Dispenser |
| 40. | Toilet Tissue Dispenser |
| 42. | Vinyl Flooring |
| 44. | Paper Towel |
| 46. | Door |
| 48. | Door Handle |
| 50. | Waste and water Connection |
| 70. | Single water line |
| 72. | Rear of toilet |
| 80. | Backside of toilet installation |
| 82. | Back wall of bathroom |
| 84. | Water source |
| 86. | Waste disposal |
| 88. | No Flush Waterless Urinal |
| 90. | Stand Alone urinal Station |
| 92. | Urinal Stand |
| 94. | Waste Holding Tank |
| 96. | Hand Sanitizer Dispenser |
| 98. | Wheels |
| 100. | Handle |
| 110. | Foldable Hand Sanitizer Stand |
| 112. | Fold-flat Hand Sanitizer Stand Body |
| 114. | Adult Height Hand Sanitizer Dispenser |
| 116. | Child or Disabled Height Hand Sanitizer Dispenser |
| 118. | Stand Bottom |
| 120. | Hand Sanitizer Dispensing Unit |
| 122. | Stand |
| 124. | Hand Sanitizer Dispenser |
| 126. | Hinged Front Panel |
| 128. | On-board Refill Units |

DETAILED DESCRIPTION OF THE INVENTION

Therefore, in accordance with the present invention, a number of water saving, space saving compact bathroom components, including a toilet and sink combination, a waterless urinal and a hand sanitizer dispensing station, are disclosed. Such bathroom components may preferably be installed in a standalone portable comfort station, in standalone applications, or they may even be utilized in permanent residential or commercial buildings.

A preferred aspect of the plumbing for these aspects, including the compact toilet and sink combination, is disclosed in my earlier patent, U.S. Pat. No. 6,721,967, which is incorporated herein in its entirety into this patent application to provide full disclosure of a preferred working device. My '967 patent disclosure relates to a P-Trap and tank, which when employed with the present compact toilet and sink, provides a usable configuration for use in portable buildings, recreation vehicles, tiny houses, and the like.

In this regard, and for these small space applications, the space saving feature of this invention is important because the "real estate" within the bathroom can now be used to install additional equipment that might not have been able to be included due to space constraints. Now this space can be used for installing other conveniences such as electricity for an automatic hand dryer for a paperless hand wash environment, overhead heat/AC units, and lighting, among other desirable features. Lavatory shelter portability for emergencies is increased for some applications because the present invention makes it possible to offer fresh water flushing toilets and fresh water hand wash sanitation within a folding bathroom shelter. The present invention could even be placed in a shower stall, thereby allowing for a common space to both shower and to use the toilet and the face sink. Maintenance is also minimized because antifreeze protection is simplified for both the sink and the toilet.

Of special interest to the remodeling and/or building construction industry would be a mobile, compact, complete bathroom stall consisting of a face sink and a toilet that can be custom manufactured to fit pre-assembled through a conventional 34" door opening. For instance, a construction worker in a high rise condo complex that did not yet have bathroom facilities would be able to use a pallet jack to wheel one of our compact bathroom stalls into such a condo during construction in progress. The unit is compact and sized such that it could fit into an elevator, brought up to the condo unit in construction, and pallet jacked into the condo that was not yet completed. The convenience of such a compact, self-contained bathroom stall would be available to the workers, where traditionally, there would not have been a convenient facility to relieve themselves. Collected waste would be taken out and properly disposed of.

In certain aspects of the present invention, both a cistern and a sink can be placed in any part of a room or in an adjacent room and can be plumbed to the toilet in either a comfort station, a portable shelter or even in a standard bathroom. In that event, the water flow could be regulated with automatic shutoffs in combination with an overflow line to prevent water overflow or spillage. The sink can be placed in a separate room and may include an eye wash station. There could even be more than one sink, such as actually on the toilet, or it could even be located in another room. Perhaps, even the sink could be in an adjacent laundry room so that the grey water could be used for flushing the toilet. In other words, the sink could be put anywhere, and the waste water could be used to flush.

Specifically, the grey water generated by hand or face washing in the sink is collected and subsequently used to flush the toilet. For example, one would relieve oneself in the toilet, without flushing yet, followed by washing your hands in the sink with fresh water, whereby the newly hand wash generated grey water is collected, and then that grey water is used to flush the toilet. Consequently, water is saved because the hand wash water is used to flush the toilet.

In addition, there is a considerable savings of water that increases user convenience levels by offering either a ready waterless hand sanitizer dispenser, or a fresh water hand wash as well as real toilet flushing. In essence, since sink grey water is used a second time for the flushing of the toilet black water, a reduction of water required for these functions is realized. Moreover, a cleanliness claim can be made because soap in the cistern sink water effluent will clean the toilet as it is flushed. For the present invention, in various aspects, a single water line is needed for operation. This also means that numerous water sources can be used, including, but not limited to, garden hoses, water tanks, or even conventional hard plumbing. Waste disposal can be accomplished in many ways by the use of, for example, a holding tank, septic system, or a sewer system.

The present combination sink and toilet may be manufactured through any suitable means, including, but not limited to, rotocasting, thermoforming, sand casting, blow molding, porcelain manufacturing and the like. The materials used may be any suitable material, but may include ceramics, plastics, metal and the like. The combination sink and toilet may be manufactured on either an S-trap or P-trap type toilet bowl. An S-trap might be especially advantageous for applications where a ground level application is not required. The P-trap configuration might be especially advantageous where ground level is a requirement.

Water control for the sink may utilize a faucet with an automatic shut-off system to prevent over-filling of the grey water into the cistern. This is especially useful for instances when the supply of water is limited, as when a water tank is the supply of fresh water. Of course, the user would have a faucet handle to stop the water flow to the cistern when it might be necessary. This is especially true if the sink/toilet combination is connected to a live water system where a shut-off would be most advantageous.

Referring now to the drawings, FIG. 1 illustrates a perspective view of a toilet and sink combination made in accordance with the present invention, generally denoted by numeral 10, including a tank 28 formed on top of a toilet base 34 with toilet bowl 32. A lid 30 is secured on top of toilet bowl 32, which prevents overspray of liquid inside toilet bowl 32 when it is flushed. A tank lid 26 is formed to sit on top of tank 28. A sink 24 is formed within tank lid 26 and has a drain 25 formed therein. A faucet 20 is seated in tank lid 26 and includes a spout 16 having an aerator 18 at its distal end. Handle 12 is telescopically mounted to handle body 14 capable of activating faucet 20. Handle 12 can be placed into several positions, as described more fully hereinbelow. Near the base of faucet 20 is a flush button 22, which can optionally have two different flush modes, one for liquid waste and a second for solid waste flushing.

Figure 2:
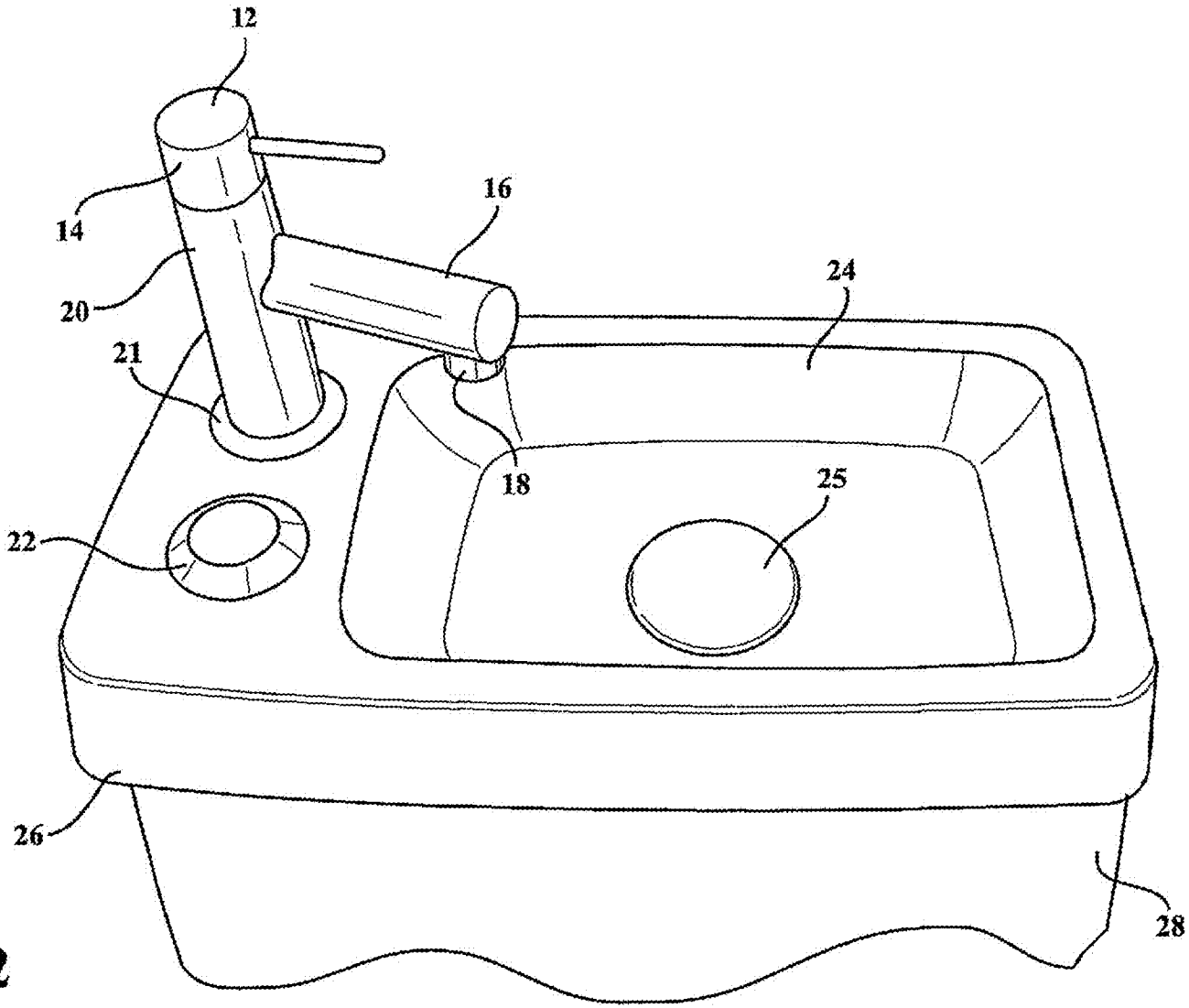
FIG. 2 is a top perspective view of the sink portion of the present invention.

FIG. 2 is a top perspective view of the sink portion of the present invention, including a faucet 20, a tank lid 26 having a drain 25 formed into the bottom of the depression of sink 24. Faucet 20 is activated by handle 12 and handle body 14. Faucet 20 is secured to tank lid 26 by spout base 21. A flush button 22 is conveniently located near spout base 21 and may include two buttons for low-flow flushing or liquid waste and high-volume flushing for solid waste. Furthermore, faucet 20 has an integral spout 16, which may optionally include an aerator 18.

Figure 3:
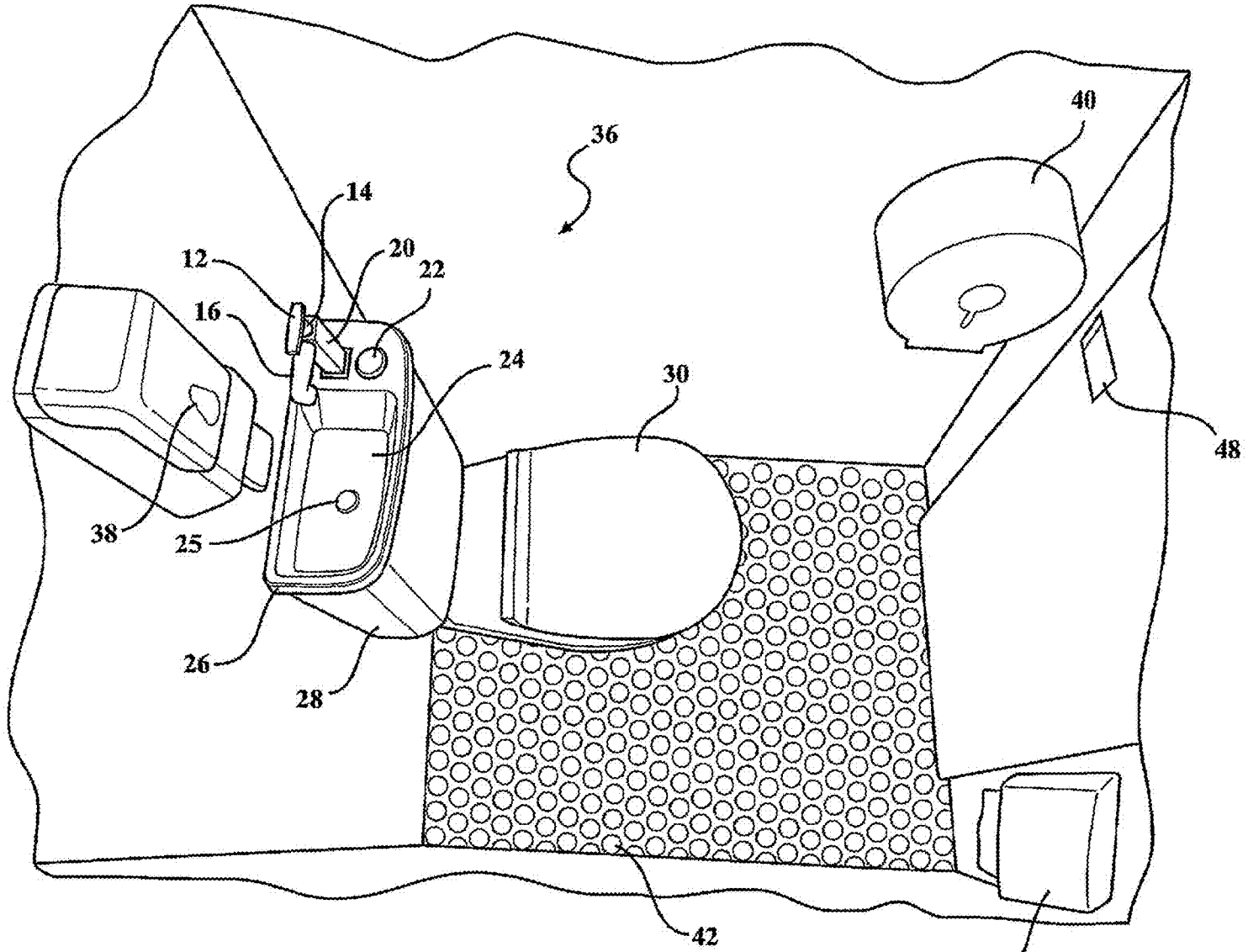
FIG. 3. is a perspective view of the possible potential placement of the present toilet and sink combination within a comfort station.

FIG. 3 illustrates the possible potential placement of toilet and sink combination generally denoted by numeral 36 within a comfort station. Such a comfort station preferably will include a number of bathroom components, but most preferably will include at least a toilet and sink combination. Additional components may also include a hand dryer or paper towel dispenser. A hand sanitizing station is located preferably directly above toilet and sink combination 36, and may include a foaming hand soap dispenser 38, or in the alternative, may have a hand sanitizer dispenser, preferably a gel-type alcohol-containing composition. A toilet tissue dispenser 40 may be located anywhere in the comfort station that is convenient for use. In this aspect, a paper towel dispenser 44 may also be located anywhere within the room for convenience. Furthermore, in this aspect, vinyl flooring 42 is preferably used on the floor of the comfort station, which is accessed by door 46 and activated by door handle 48.

Figure 4:
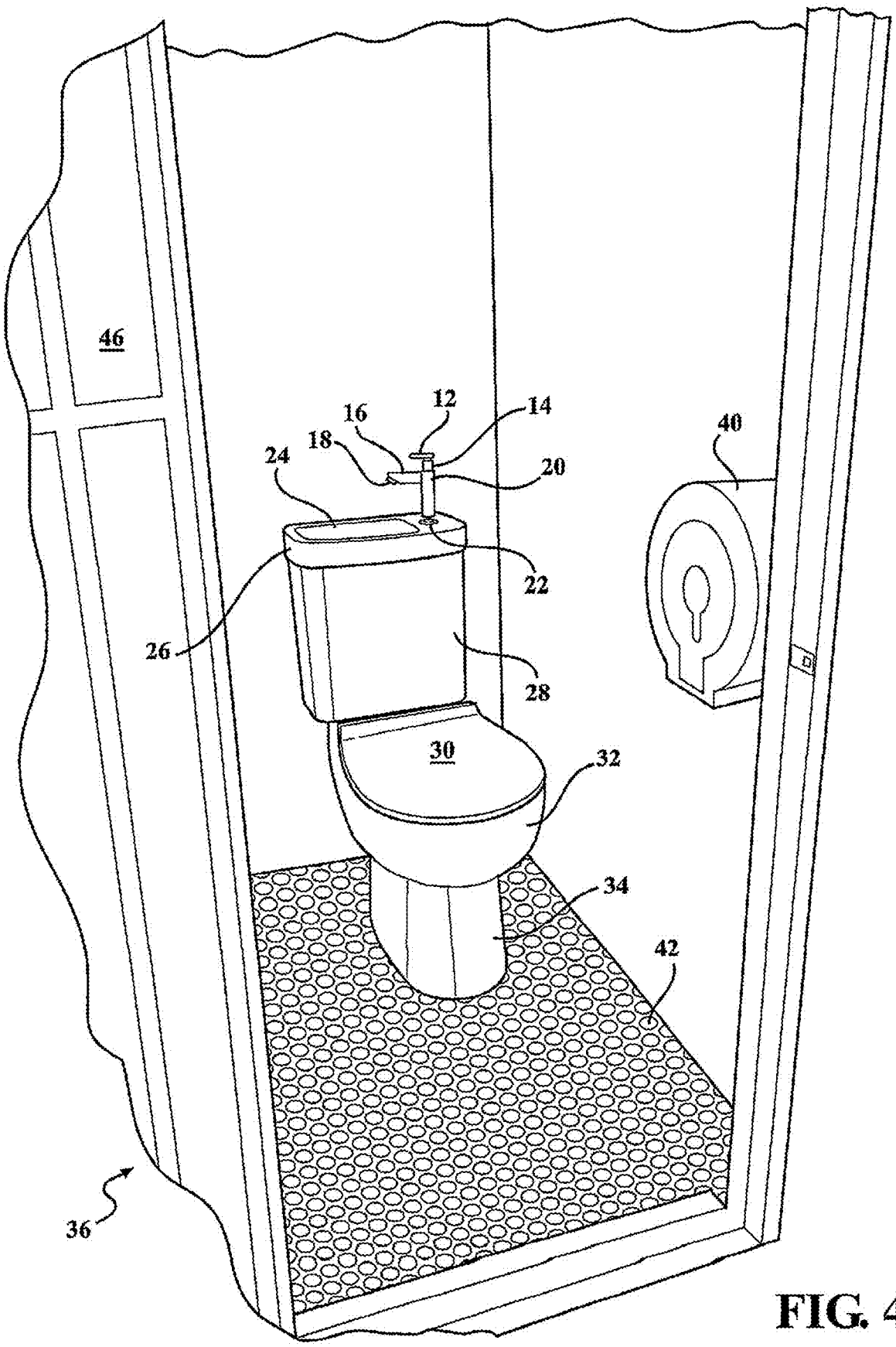
FIG. 4 is a perspective view looking through a door of the comfort station.

FIG. 4 is a perspective view looking through door 46 of the comfort station at the toilet and sink combination 36. Toilet tissue dispenser 40 is shown in a convenient location attached to the wall of the comfort station. As shown in this illustration, lid 30 is in the down position on toilet bowl 32 attached to toilet base 34. Again, a tank lid 26 is atop tank 28, wherein a sink 24 is formed within tank lid 26. Faucet 20 is located next to sink 24 and by activating handle 12, water coming from spout 16 can be used for washing hands in sink 24.

Figure 6:
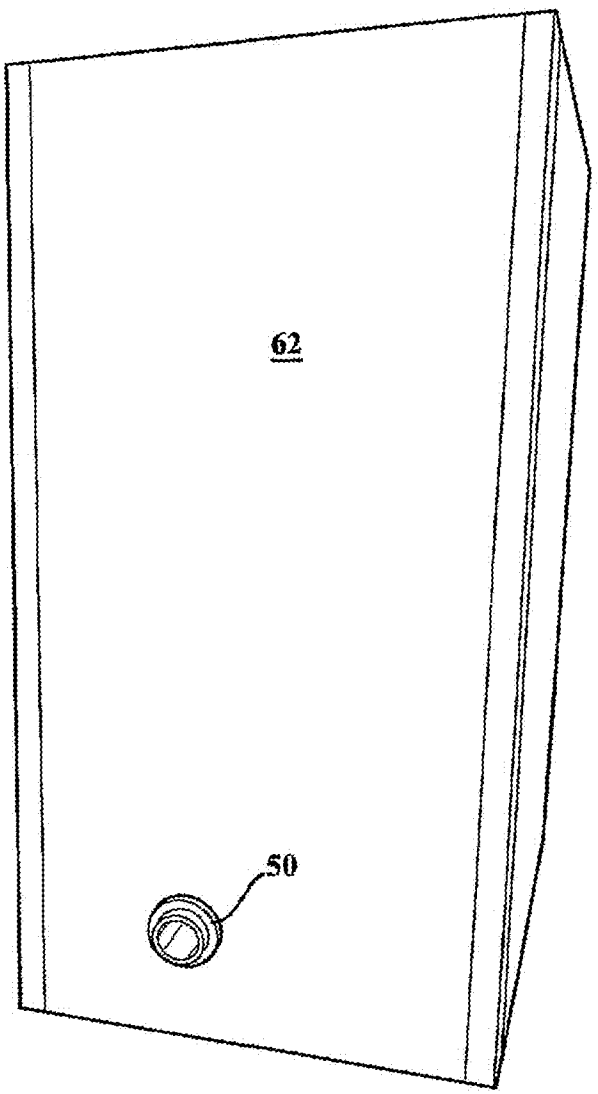
FIG. 6 also shows the relative placement of convenience items in the comfort station.
Figure 5:
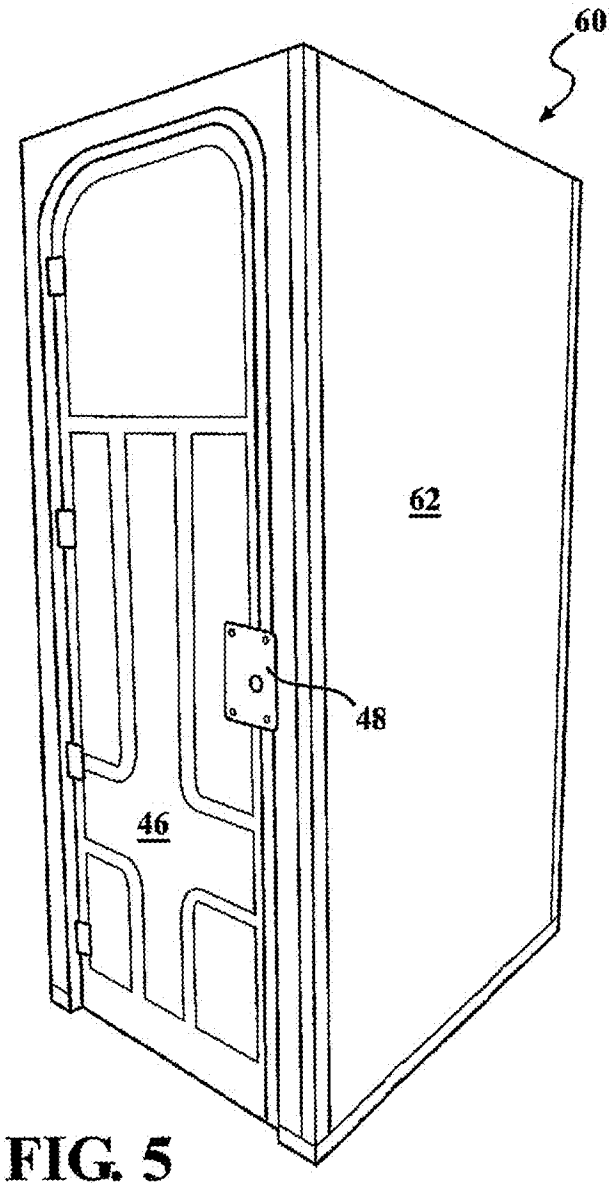
FIG. 5 is a perspective view of the comfort station.

With combined reference to FIG. 5 and FIG. 6, a comfort station is shown with some traditional components, and is generally denoted by numeral 60. The comfort station 60 is shown having a door 48 on a comfort station housing 62 for enclosing at least a toilet and sink combination. Door 46 includes a door handle 48 for access into comfort station 60. Waste water connection 50 is the outlet to a waste tank or sewer (not shown). The waste tank can be removed and taken to a proper waste disposal, such as a flush toilet or sewer, where the waste can be properly disposed of.

Figure 7A:
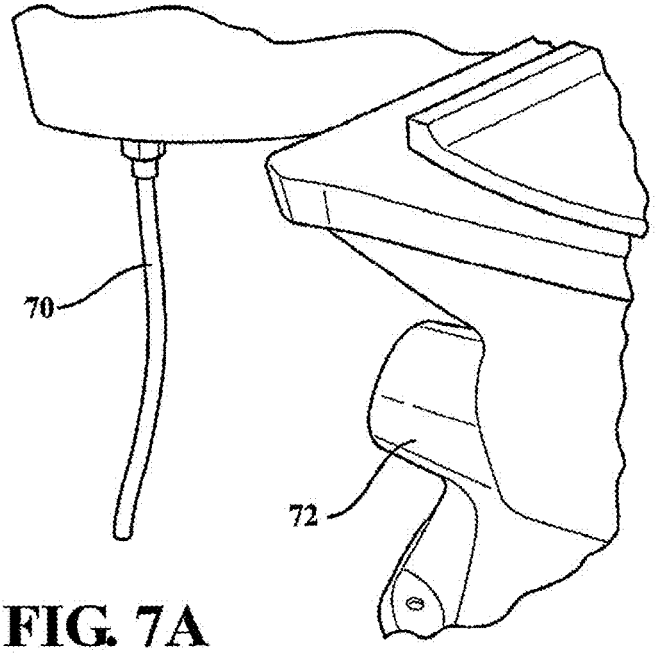
FIG. 7A shows the single water line connection.
Figure 7B:
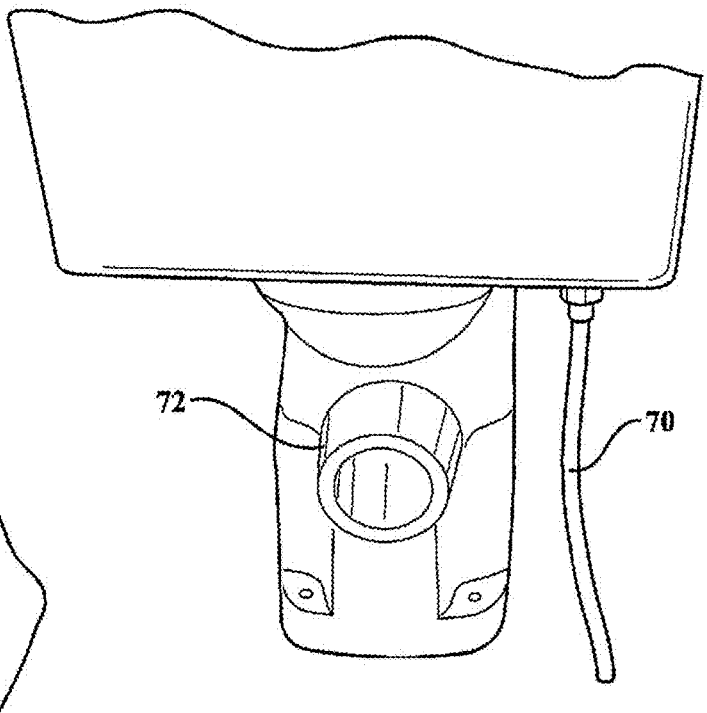
FIG. 7B is another view of the single water line.

FIG. 7A shows yet another aspect of the present invention illustrating a single water line connection up to the sink above the toilet cistern. Single water line 70 comes up through the floor in this aspect and reaches up to the sink faucet as shown in previous figures. The discharge is not shown hooked up in this figure to the back of the toilet 72. FIG. 7B is another view of the single water line 70 in relation to the back of toilet 72.

One of the true advantages and novelty of this invention is that once someone uses the toilet, they then wash their hands in the sink and the grey waste water generated from the hand washing operation is used to flush the toilet. This means that only one water line is necessary to operate both the sink and the toilet because the water inlet brings fresh water to the faucet which is turned on during the hand washing operation. Once the cistern collects and contains the hand washing water, then flushing can take place by only using a single water line to the toilet and sink combination. The fact that there is only a single water line alleviates costs associated with installation, materials, maintenance and labor as opposed to other installations with multiple water lines.

Figure 8:
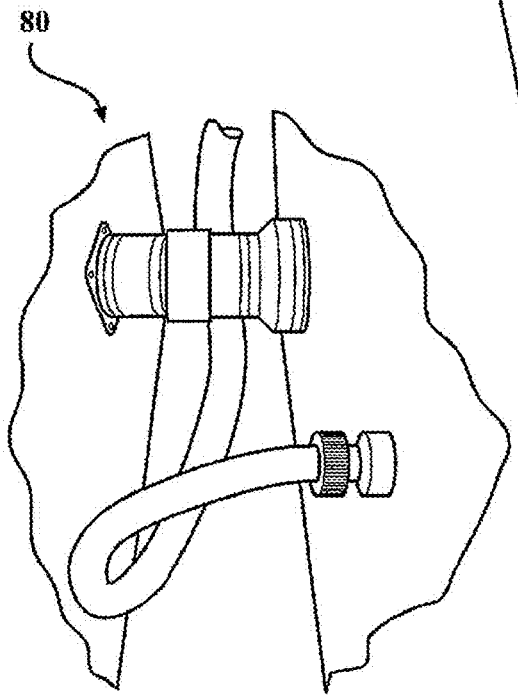
FIG. 8 shows the back wall of a bathroom stall unit.

FIG. 8 shows the back wall 82 of a comfort station or bathroom stall unit generally denoted by numeral 80, and shows the relative placement of the various connections, including water source 84 and waste disposal 86 coming out of the back of the bathroom stall unit 80.

Figure 9B:
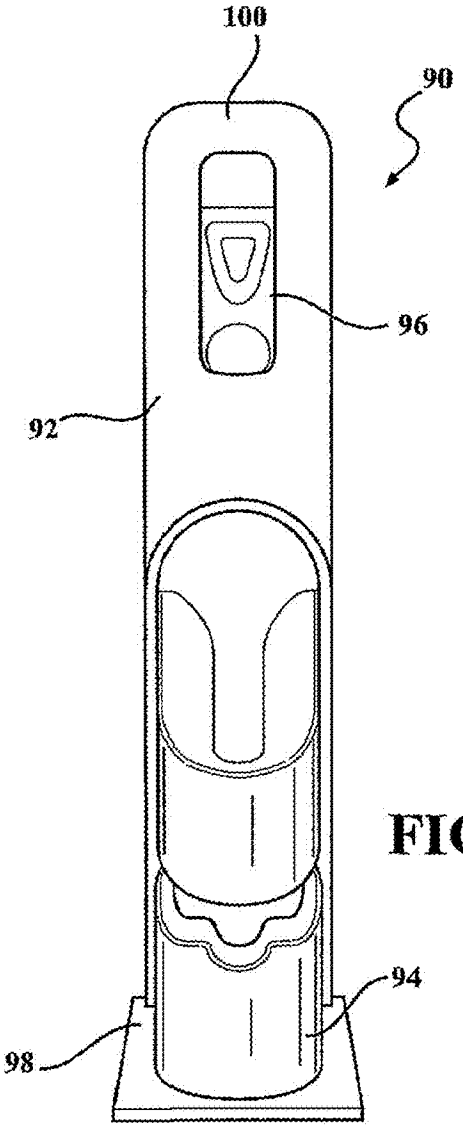
FIG. 9B shows another aspect of the same waterless urinal on a mobile stand.
Figure 9A:
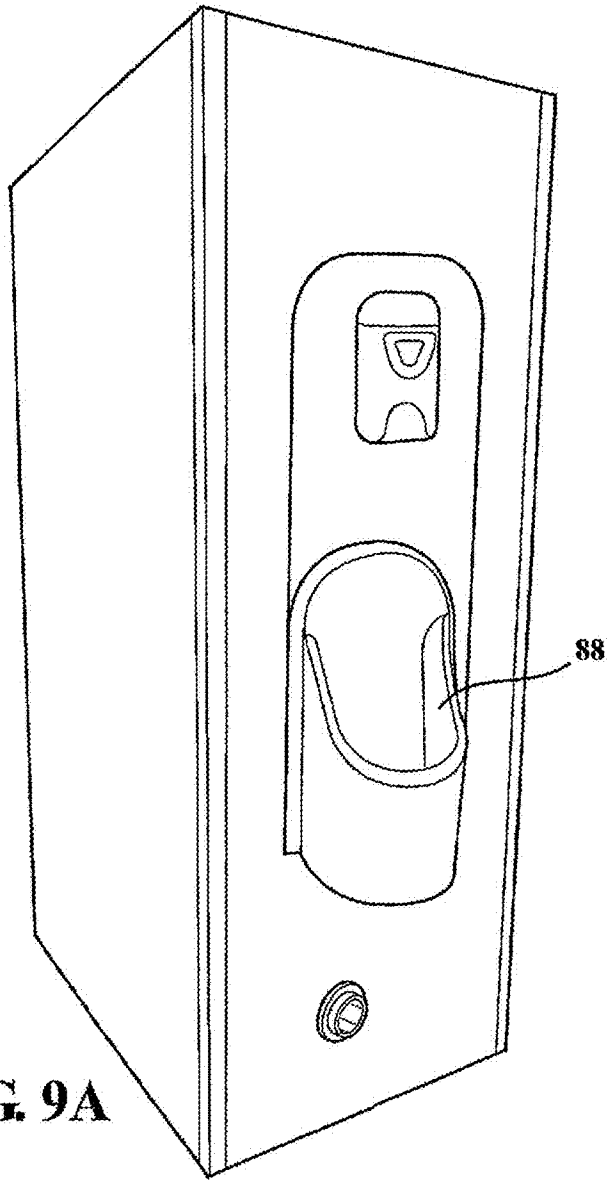
FIG. 9A illustrates a rear wall mounted waterless urinal.

FIGS. 9A and 9B show yet further aspects of the present invention which further comprise a no flush waterless urinal generally denoted by the numeral 88. As will be discussed immediately hereinbelow, several mounting options for waterless urinal 88 are possible, including either a semi-permanent attachment to an interior wall or the rear wall of a comfort station or, in the alternative, a mounting option on a mobile urinal stand. When installed on the comfort station, placement on the exterior rear wall is preferable because the urinal itself will not interfere with wheeling the comfort station in and out of conventional door openings. In that regard, one can see that FIG. 9A illustrates urinal 88 installed on the rear wall of the enclosure of the above figures, while FIG. 9B illustrates the no-flush waterless urinal mounted on a standalone urinal station 90.

Still referring to FIG. 9A, it is clear that waterless urinal 88 may also be installed on an interior wall of a comfort station (not shown here) so that a user could go inside the comfort station and close the door for privacy.

Looking again to FIG. 9B, yet another aspect of the present invention shows a standalone urinal 90 that includes a stand 92 and a waste holding tank 94 with a sealable cap for ease of removal and drainage without spillage. Discharged urine is merely collected in waste holding tank 94 for later disposal in an appropriate facility, hence the reason the instant urinal is waterless. The waterless urinal of FIG. 9B may also be mounted on any exterior surface of the basic comfort station illustrated in the figures above. Each of the aspects of the present invention may include hand sanitizer dispensers 96 attached in convenient locations. These various aspects of a waterless urinal may be utilized for greater convenience and efficiency, especially on a factory floor or for a construction crew. This convenience becomes more apparent as one worker might be using the interior of the comfort station unit, while another worker could use the rear mounted urinal 88 at the same time.

Referring again to FIGS. 9A and 9B, hand sanitizer dispensers may be located in any convenient location for employment after use of the urinal 88. Optional wheels 98 can be located on the bottom of the mobile waterless urinal aspect of the present invention as shown in FIG. 9B for convenient travel to a traditional plumbed toilet for emptying. It is also adapted to be plumbed into an existing sewer line if that would be convenient, so that emptying of the waterless urinal would be accomplished through the sewer line. In yet a further aspect of the waterless urinal 88 of FIGS. 9A and 9B, a handle 100 may be employed at the top of the unit to aid in movement and/or emptying of urinal 88.

Figure 10A:
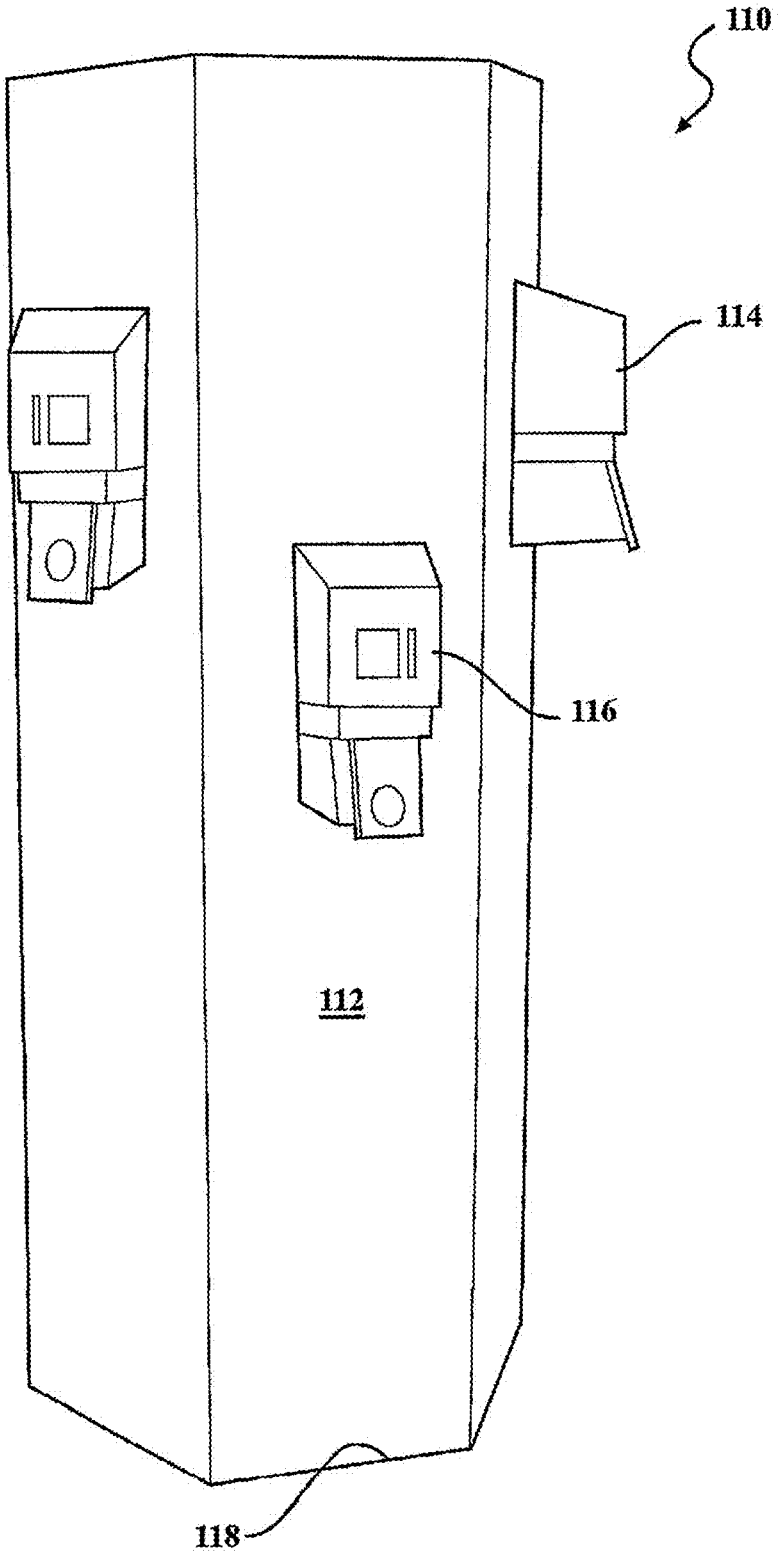
FIG. 10A illustrates a foldable multi-hand sanitizer standalone unit with different heights of dispensers for adults, children and wheelchair persons.

Looking next to another aspect of the present invention, FIG. 10A illustrates an erectable and easy-to-ship foldable multi-hand sanitizer standalone unit, potentially with different heights of hand sanitizer dispensers in appropriate height locations for adults, children and wheelchair persons. This foldable hand sanitizer stand is generally denoted by the numeral 110 and includes an erectable fold-flat hand sanitizer stand body 112 upon which at least one hand sanitizer dispenser is mounted. An adult height hand sanitizer dispenser 114 is mounted at an appropriate height for adults, while a hand sanitizer dispenser 116 is mounted for children and the disabled in wheelchairs. Stand 110 is preferably made of a weatherproof thermoplastic, or any other suitable material and may be a flat sheeted material capable of being folded into a sturdy stand of at least a rectangular shape for a total possible of four hand sanitizer dispensers, while a hexagon could have six dispensers mounted thereon and so on. The hand sanitizer dispensers can be mounted on the stand after erection, such that the flat sheeted material can be shipped flat, and the dispensers mounted after assembly. Preferably, the stand bottom 118 would be weighted to stabilize the stand in windy conditions and while in use.

Figure 10C:
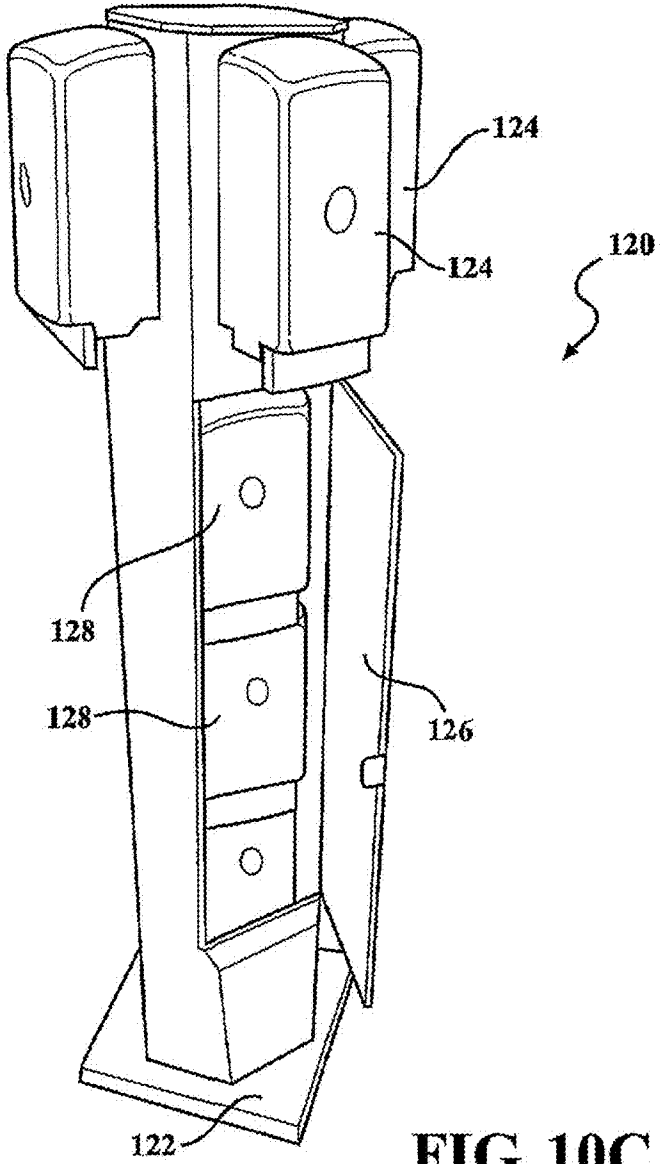
FIG. 10C is a perspective view of the hand sanitizer dispensing unit of FIG. 10B, showing the front panel open to reveal on-board refill units stored in the body of the stand.
Figure 10B:
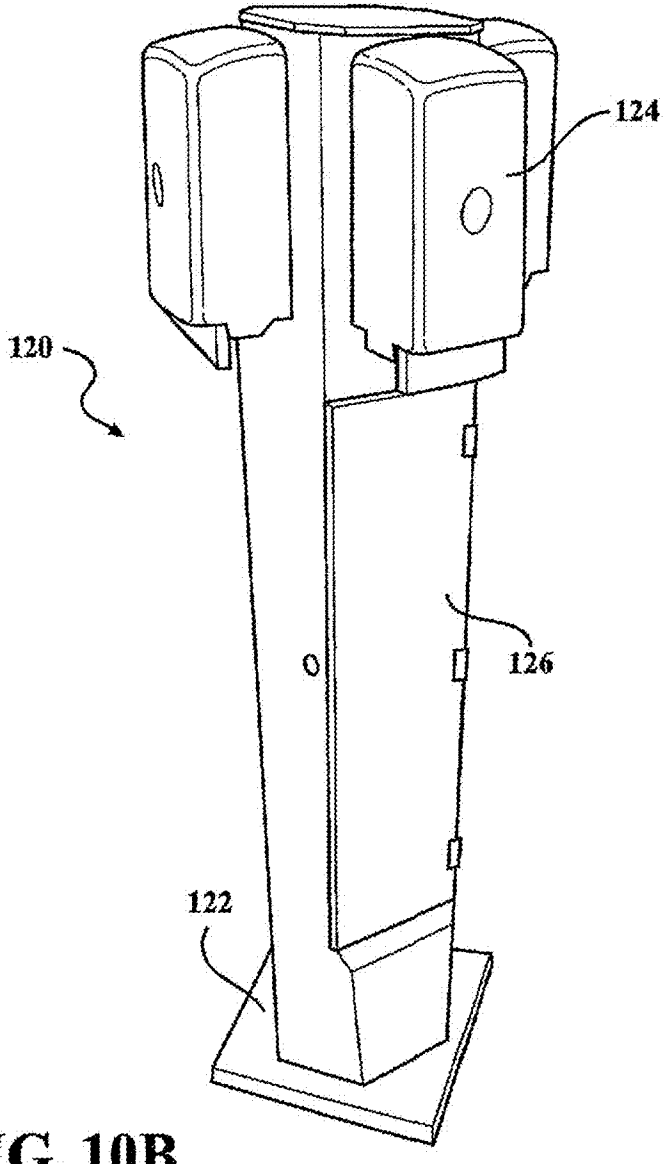
FIG. 10B illustrates another aspect of the hand sanitizer dispensing unit made in accordance with the present invention.

With combined reference to FIGS. 10B and 10C, there is illustrated yet another aspect of a hand sanitizer dispensing unit generally denoted by numeral 120 that is made in accordance with the present invention. This aspect includes a self-contained refill station with a weighted base and stand 122 to which at least one hand sanitizer dispenser 124 is mounted. A hinged front panel 126 conceals a number of hand sanitizer dispenser refills 128 as shown in FIG. 10C, which is a perspective view of the hand sanitizer dispensing unit of FIG. 10B, showing the front panel open to reveal the on-board refill units 128 stored in the body of the stand. As can be seen in FIG. 10C, front panel 126 conceals the refills 128, and may be locked to prevent theft or vandalism. This aspect of the invention may also be preferably made of a weatherproof material. Weight 125 in the bottom of the stand may be used to stabilize the stand in windy conditions or while being used.

The foregoing description of a preferred aspect of the invention has been presented for purposes of illustration and description. It is not intended to be exhaustive or to limit the invention to the precise form disclosed. Obvious modifications or variations are possible in light of the above teachings with regards to the specific aspects. The aspect was chosen and described in order to best illustrate the principles of the invention and its practical applications to thereby enable one of ordinary skill in the art to best utilize the invention in various aspects and with various modifications as are suited to the particular use contemplated.

What is claimed is:

1. A waterless hand sanitizer dispenser unit, comprising:

a standalone unit having multiple vertical sides having at least two hand sanitizer dispensers mounted thereon on their face, said standalone unit being made of a flat sheeted material construction made of a weatherproof thermoplastic with hand sanitizer dispensers mounted on the stand after erection, such that the flat sheeted material can be shipped flat, and the dispensers mounted after assembly;

a weighted bottom of the standalone unit for stability with weights in the bottom of the stand to stabilize the stand in windy conditions;

a self-contained refill station having refills sized to be stacked within the refill station under the handsanitizer mounted on the face of a vertical side having a lockable hinged front concealment panel to cover and secure similarly sized refill containers of the hand sanitizer material;

wherein said standalone unit with the hand sanitizer dispensers mounted thereon is suitable for indoor and outdoor applications with different heights of hand sanitizer dispensers in appropriate height locations for adults, children and disabled or wheelchair persons.

* * * * *